United States Patent [19]

Haneda et al.

[11] Patent Number: 4,664,067

[45] Date of Patent: May 12, 1987

[54] EXHAUST GAS HEAT RECOVERY BOILER

[75] Inventors: Hisao Haneda; Masamichi Kashiwazaki; Toshiki Motai, all of Tokyo, Japan

[73] Assignee: Mitsubishi Jukogyo Kabushiki Kaisha, Tokyo, Japan

[21] Appl. No.: 829,815

[22] Filed: Feb. 14, 1986

[30] Foreign Application Priority Data

Feb. 14, 1985 [JP] Japan ..... 60-27457

[51] Int. Cl.[4] ..... F22D 1/00

[52] U.S. Cl. ..... 122/7 R; 122/1 A

[58] Field of Search ..... 122/7 R, 1 R, 1 A, 20 B

[56] References Cited

U.S. PATENT DOCUMENTS

| | | | |
|---|---|---|---|
| 2,699,758 | 1/1955 | Dalin | 122/1 A |
| 2,713,330 | 7/1955 | Taylor | 122/1 A |
| 2,743,583 | 5/1956 | Bayard | 122/1 A |
| 2,762,201 | 9/1956 | Sampson | 122/1 A |
| 2,762,345 | 9/1956 | Bayard | 122/1 A |
| 2,795,213 | 6/1957 | Cooper | 122/1 A |
| 4,288,979 | 9/1981 | Liljedahl et al. | 60/39.12 |
| 4,403,571 | 9/1983 | Kochey, Jr. | 122/1 A |
| 4,501,233 | 2/1985 | Kusaka | 122/7 R |
| 4,572,110 | 2/1986 | Haeflich | 122/7 R |
| 4,576,121 | 3/1986 | Thorogood | 122/7 R |

*Primary Examiner*—Henry C. Yuen

*Attorney, Agent, or Firm*—Wenderoth, Lind & Ponack

[57] ABSTRACT

An exhaust gas boiler including a plurality of superheaters and reheaters disposed separately in a side-by-side relationship with each other in the upstream of exhaust gas flow and in a plane across the complete of said exhaust gas boiler, which comprises in combination a plurality of superheater means and reheater means separated into primary and secondary groups respectively in such a manner that the secondary superheater means and secondary reheater means are disposed side by side with each other, the primary reheater means being in the downstream of the secondary superheater means and the primary superheater means in the downstream of the secondary reheater means, the primary superheater means and the secondary superheater means being connected with each other, the primary reheater means and the secondary reheater means being connected with each other, respectively, and that there are provided a plurality of pass partition means between the superheater means and the reheater means.

1 Claim, 2 Drawing Figures

EXHAUST GAS HEAT RECOVERY BOILER

BACKGROUND OF THE INVENTION

1. Field of the Invention

The present invention relates generally to an improvement in or relating to exhaust gas heat recovery boiler, and more particularly to an improved exhaust gas boiler for recovering heat generated from exhaust gas from a variety of heat generating means such as a gas turbine, a diesel engine, a cement baking furnace, and the like.

2. Description of the Prior Art

It is a typical construction of a conventional exhaust gas combustion boiler such that there are disposed a plurality of superheaters and reheaters in a side-by-side relationship with each other, yet not arranged in divisional stages in the upstream of an exhaust gas flow in the flow passage of an exhaust gas boiler. Also, it is known in construction of such an exhaust gas boiler that there is provided an evporator in the downstream of these superheaters and reheaters, and an economizer disposed in the further downstream of the exhaust gas flow.

With such a common construction, it is designed that an exhaust gas at a high temperature from combustion may exchange heat with the superheaters, the reheaters, the evaporator and the fluid passing in the economizer so that is is ccooled off while flowing from the area where there are provided the superheaters and the reheaters down to the low pressure side where the economizer is disposed, thereafter flowing outwardly from the boiler. Feed water is supplied from a water supply pump or the like through a water feed pipe up to the economizer, where feed water is heated by exhaust gas. Thus-heated feed water is then delivered to a water vapor drum. Part of feed water within the vapor drum is directed to the evaporator, where it is reheated by exhaust gas to be a phase of vapor-water mixture, which is returned to the vapor drum. Vapor-water mixture fluid thus-returned is then separated into vapor and water, which vapor is superheated by exhaust gas in the superheater to a high temperature and high pressure vapor which is to be fed to the steam turbine. Vapor fed to the steam turbine works to drive it in rotation, thereafter being discharged out of the turbine, and then fed to the reheater, where it is superheated again to be vapor which is either to be fed to the lower pressure stage of the steam turbine to work in driving the same or to be used as vapor for miscellaneous use.

With the conventional exhaust gas boiler of such a typical construction as reviewed hereinbefore, there were such inconveniences in practice that it was not feasible to attain a due distribution of exhaust gas into a superheater and a reheater, and a due control on a superheating temperature of vapor to be superheated by way of the superheater and the reheater, and also to feed vapor of stable pressure and temperature to the steam turbine.

In consideration of such inconveniences in use which are particular to the conventional exhaust gas boiler arrangement, there is a desire to provide an efficient resolution therefor.

The present invention is essentially directed to the provision of a due and proper resolution to such inconveniences and retrictions as reviewed above and experienced in practice of these conventional arrangement, which have been left unattended with any proper countermeasures so far.

SUMMARY OF THE INVENTION

It is therefore a primary object of the present invention to provide an improved exhaust gas boiler in which an advantageous directivity of exhaust gas can be made available in the distribution of an exhaust gas flow between the superheater and the reheater, so that a due control on the temperature of exhaust gas may be attained.

It is another object of the invention is to provde an improved exhaust gas boiler in which vapor of constant pressure and temperature may be fed to a steam turbine.

It is a further object of the invention is to provide an improved exhaust gas boiler in which an efficient recovery of heat from exhaust gas may be attained.

It is a still other objet of the invention is to provide an improved exhaust gas boiler in which no control damper is required for the control of exhaust gas flow rate, thus making the construction of a boiler simpler and thus contributing to the improvement in operability and maintenance.

The above objects of the invention can be attained efficiently from the improved exhaust gas boiler including a plurality of superheaters and reheaters disposed separately in a side-by-side relationship with each other in the upstream of exhaust gas flow and in a plane across the complete of said exhaust gas boiler, which comprises, as summarized in brief, a plurality of superheater means and reheater means separated into primary and secondary groups respectively in such a manner that the secondary superheater means and secondary reheater means are disposed side by side with each other, the primary reheater means being in the downstream of the secondary superheater means and the primary superheater means in the downstream of the secondary reheater means, the primary superheater means and the secondary superheater means being connected with each other, the primary reheater means and the secondary reheater means being connected with each other, respectively, and that there are provided a plurality of pass partition means between the superheater means and the reheater means.

With this advantageous construction of the invention, there is attained such an advantageous effect that there can be established a due separation of gas path, so that exhaust gas can be guided to be in a proper gas flow, and so that the temperatures of gases flowing in the downstream of the primary superheater and the primary reheater may be made generally identical.

The principle, nature and details of the present invention will, as well as advantages thereof, become more apparent from the following detailed description by way of a preferred embodiment of the invention, when read in conjunction with the accompanying drawings, in which like parts are designated at like reference numerals.

DETAILED DESCRIPTION OF THE PREFERRED EMBODIMENT

The present invention will now be described in detail by way of example with, but not by restriction in any way to, a preferred embodiment thereof in conjunction with the accompanying drawings, as follows.

Figure 1:
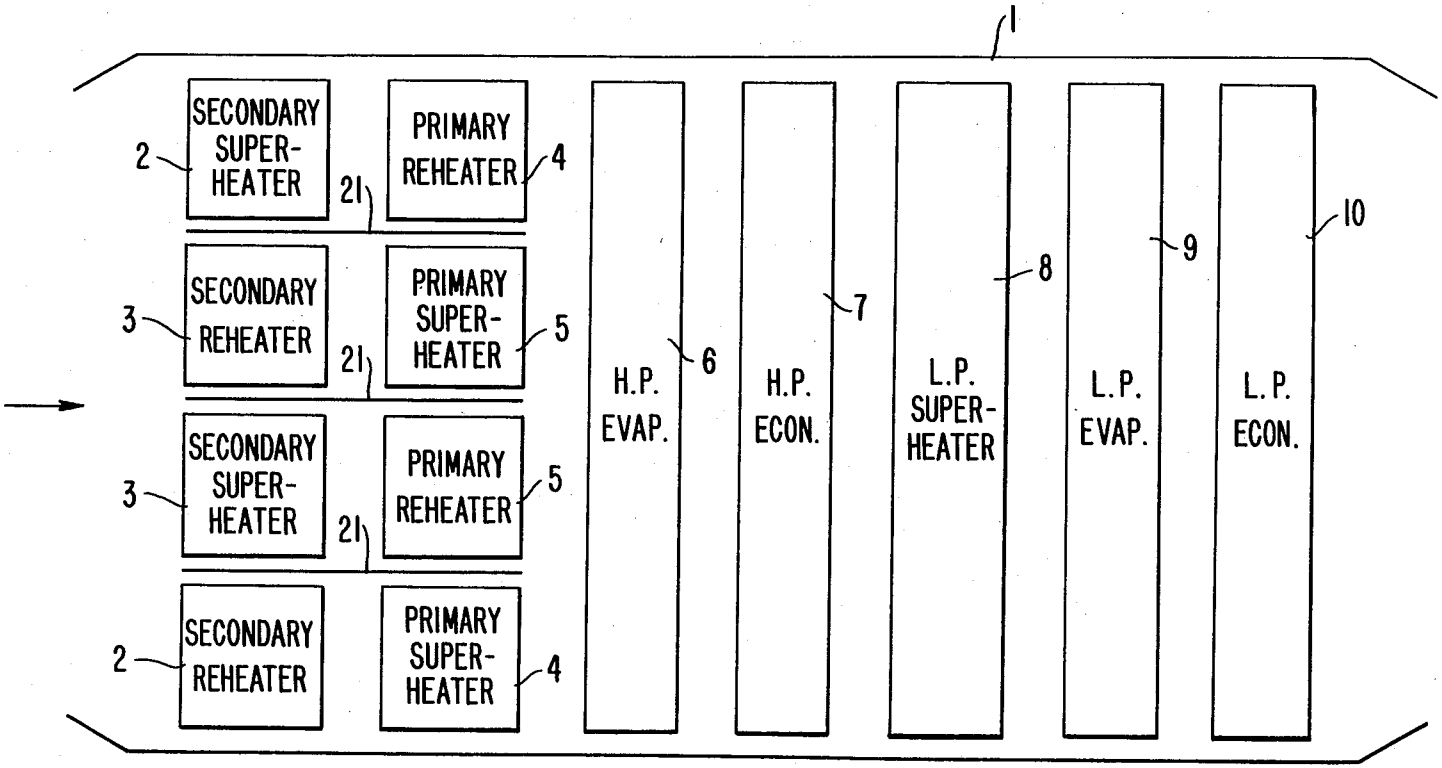
FIG. 1 is a sschematic longitudinal cross-sectional view showing the improved exhaust gas boiler construction by way of a preferred embodiment of the invention.
Figure 2:
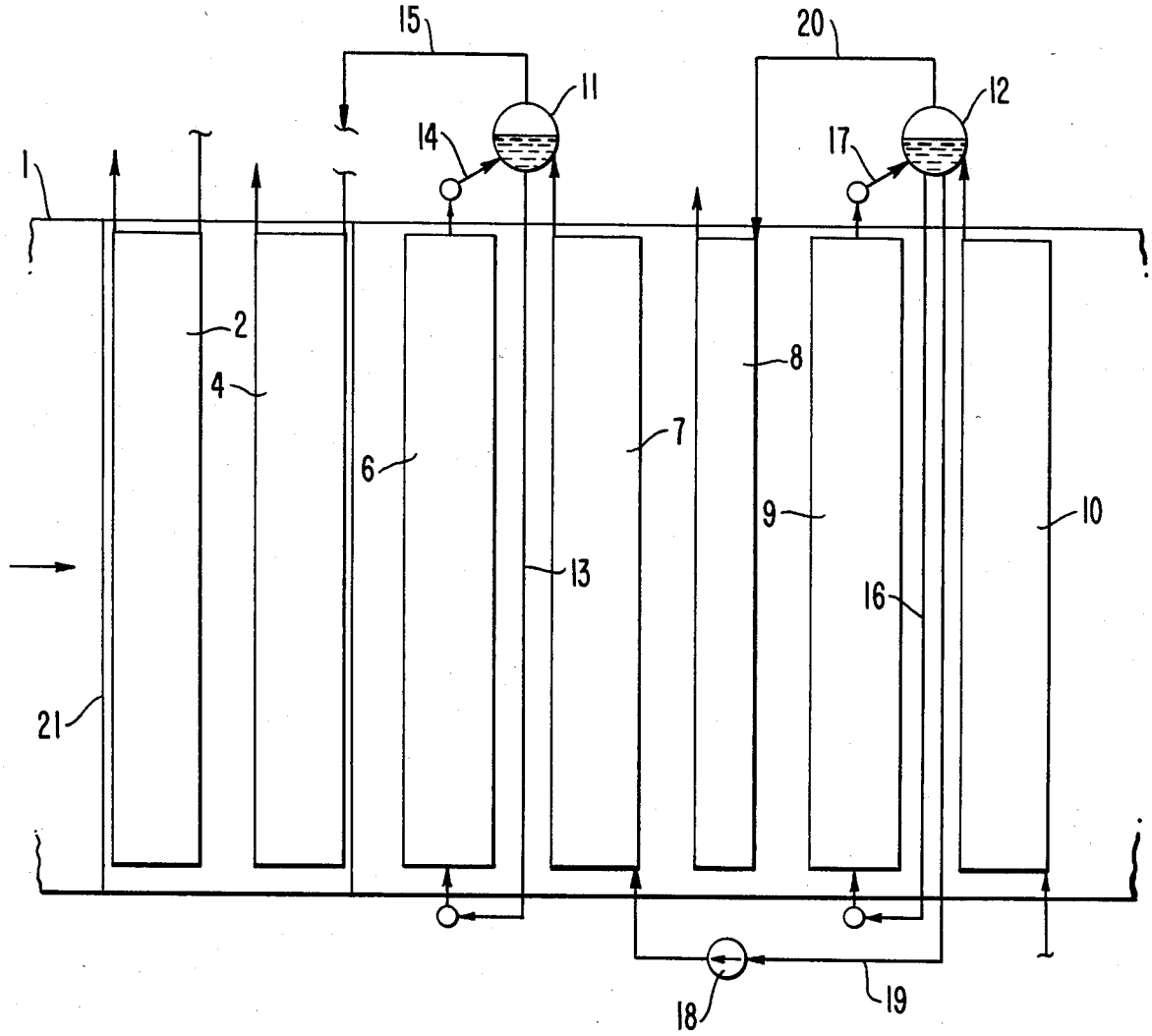
FIG. 2 is a front view showing the same embodiment of the invention.

Now, referring to FIGS. 1 and 2, there are shown provided a plurality of secondary superheaters 2 and a plurality of secondary reheaters 3 in a side-by-side relationship at the foremost point in the upstream of the exhaust gas flow in the flow passage of an exhaust gas boiler complete 1 where exhaust gas passes through. In the downstream of the secondary superheater 2 there are disposed a plurality of primary reheaters 4, and in the downstream of the secondary reheater 3 there are disposed a plurality of primary superheaters 5, and also in a further downstream of these components there is provided a high pressure evaporator 6. In the downstream of the high pressure evaporator 6, there is shown provided a high pressure economizer 7. In the further downstream of the high pressure economizer 7, there are seen provided a low pressure superheater 8, a low pressure evaporator 9 and a low pressure economizer 10. Upon the complete 1 of the exhaust gas boiler, there are provided a high pressure vapor drum 11 and a low pressure vapor drum 12, respectively. The high pressure vapor drum 11 is connected operatively to the outlet of the high pressure economizer 7, and is further connected to the lower header of the high pressure evaporator 6 by a downcomer 13. Also, the header on the upper part of a high pressure evaporator 36 and the high pressure vapor drum 11 communicate with each other by way of a riser 14. In addition, the vapor area of the high pressure vapor drum 11 is connected to the inlet to the primary superheater 5 by way of a vapor pipe 15. The low pressure drum 12 is likewise connected to the outlet of the low pressure economizer 10, and to the lower header of the low pressure evaporator 9 by way of a downcomer 16, and the upper header of the low pressure evaporator 9 and the low pressure drum 12 are connected with each other by way of a riser 17. This inlet side of the high pressure economizer 7 is connected to the lower pressure drum 12 and with a water supply piping 19 equipped with a water supply pump 18 disposed on way thereof. The steam area of the low pressure drum 12 is connected to the inlet to the low pressure superheater 8 by way of a vapor piping 20. Also, the inlet to the primary reheater 4 communicates with the steam turbine by way of a piping by which steam after working in the steam turbine is returned. The primary superheater 5 and the primary reheater 4 are respectively communicating with the secondary superheater 2 and the secondary reheater 3 by way of a communicating pipe having a vapor temperature reduction device equipped on way thereof. There are provided pass partition plates 21 between the superheaters and the reheaters disposed in a side-by-side relationship.

In operation, when exhaust gas flows from the side of the secondary superheater 2 to the low pressure economizer 10, it may exchange heat with the fluids passing in their respective heat exchangers, having its temperature lowered accordingly so that it may come out of the exhaust gas boiler complete 1. Feed water is supplied to the low pressure economizer 10 by way of a water supply piping, where it is heated by exhaust gas. Thus-heated feed water is then fed to the low pressure drum 12. Part of feed water in the low pressure drum 12 may be directed to the low pressure evaporator 9 by way of downcomer 16, where it is heated by exhaust gas to be a vapor-water mixture fluid, and then returned to the low pressure drum 12 by way of the riser 17. Thus-returned vapor-water mixture fluid is then separated into vapor and water, which vapor is fed to the low pressure superheater 8, where it is superheated. Part of feed water in the low pressure drum 12 is directed through the water supply piping 19, and is put under pressure by the water supply pump 18 so that it may be fed under high pressure to the high pressure economizer 7. In this high pressure economizer 7, it is heated by exhaust gas to a high temperature, and then delivered to the high pressure vapor drum 11. Feed water thus-fed to the high pressure vapor drum 11 is then fed in part to the high pressure evaporator 6 by the downcomer 13, where it is reheated by exhaust gas to be a vapor-water mixture fluid, which is to be returned to the high pressure vapor drum 11 by way of the riser 14. Thus-obtained vapor-water misture fluid is then separated into vapor and water in the inside of the high pressure vapor drum 11, which vapor is then delivered to the primary superheater 5, where it is superheated by exhaust gas. Thus-superheated vapor is then directed by way of a communicating pipe to the vapor temperature reducer, where it is controlled to a predetermined temperature, thereafter being fed into the secondary superheater 2, where it is heated to be a high-temperature and high-pressure vapor, which is to be fed into the steam turbine. After having the steam turbine driven, vapor will then be returned to the primary reheater 4, where it is superheated. Thus-superheated vapor is then sent to the vapor temperature reducer by way of a communicating pipe, where it is controlled to a predetermined temperature, therafter it is fed to the secondary reheater 3 to have vapor superheated.

According to this embodiment of the exhaust gas boiler, by virtue of such arrangement that there are the plurality of secondary superheaters 2, primary superheaters 5, secondary reheaters 3 and primary reheaters 4 disposed separately in a plurality of stages in a plane across the boiler complete 1 and there are provided a plurality of pass partition plates 21 between the superheaters and the reheaters, it is possible in practice to have a flow of exhaust gas guided properly, and also it is feasible to adjust the heating surface area, the arrangement of the heat transfer tubes and the location of the pass partition plates 21 in such a manner that the total gas draft loss in the secondary superheaters 2 and the primary reheaters 4 may be made similar to that in the secondary reheaters 3 and the primary superheaters 5, and with such adjustment in such physical arrangement of these components, no provision of a control damper or the like for adjusting a flow rate of exhaust gas is now required, thus making the exhaust gas boiler simpler in construction and thus contributing to the improvement in the operability and maintenance of the boiler on the one hand, and thus making the temperature of exhaust gases from the primary superheater 5 and the primary reheater 4 generally identical with each other, which leads to an efficient heat recovery from exhaust gas on the other.

Now, according to the advantageous effect from the adoption of such construction an exhaust gas boiler that there are provided a plurality of superheaters and reheaters separated into primary and secondary groups in such a manner that the secondary superheaters and secondary reheaters are disposed in a side-by-side relationship, with the primary reheater being in the downstream of the secondary superheater and the primary superheater in the downstream of the secondary reheater, and with the primary superheater and the secondary superheater being connected with each other and with the primary reheater and the secondary reheater being connected with each other, and that there are provided a plurality of pass partition plates between the superheaters and the reheaters, whereby there is attained such an advantageous effect that there can be established a due separation of gas path, so that exhaust gas can be guided to be in a proper gas flow, and so that the temperatures of gases flowing in the downstream of the primary superheater and the primary reheater may be made generally identical, and whereby the heat from exhaust gas can be recovered effieiently, thus making the provision of a control damper for adjusting a flow rate of exhaust gas not necessary, and thus making the boiler simpler in construction and contributing to the improvement in the operability and maintenance of the boiler, accordingly.

While the present invention has been described in detail by way of specific preferred embodiments thereof, it is to be understood that the present invention is not intended to be restricted to the details of the specific constructions shown in the preferred embodiments, but to contrary, the present invention can of course be practiced in many other arrangement to an equal advantageous effect in accordance with the foregoing teachings without any restriction thereto and without departing from the spirit and scope of the invention.

It is also to be understood that the appended claims are intended to cover all of such generic and specific features particular to the invention as disclosed herein and all statements relating to the scope of the invention, which as a matter of language might be said to fall thereunder.

What is claimed is:

1. An exhaust gas boiler comprising:

an exhaust gas passage;

a plurality of secondary superheaters and a plurality of secondary reheaters disposed separately in side-by-side relationship with each other in the upstream portion of said exhaust gas passage and in a plane across the complete width of said exhaust gas passage;

a plurality of primary super heaters and a plurality of primary reheaters disposed separately in side-by-side relationship with each other just downstream of said secondary superheaters and secondary reheaters, said primary superheaters being aligned directly downstream of said secondary reheaters and said primary reheaters being aligned directly downstream of said secondary superheaters, said primary superheaters and said secondary superheaters being connected with each other, said primary reheaters and said secondary reheaters being connected with each other, respectively; and a plurality of partition means extending in the direction of said exhaust passage between aligned pairs of superheaters and reheaters.

* * * * *